United States Patent [19]

McSwain

[11] 4,243,175

[45] Jan. 6, 1981

[54] TEMPERATURE REGULATED WALL VENTILATOR CONSTRUCTION

[76] Inventor: Edward D. McSwain, Rte. 7, Box 325, Lincolnton, N.C. 28092

[21] Appl. No.: 69,243

[22] Filed: Aug. 23, 1979

[51] Int. Cl.[3] ..... F24F 13/08

[52] U.S. Cl. ..... 236/49; 98/32; 98/40 VT; 236/101 D; 403/359

[58] Field of Search ..... 98/32, 37, 40 VT, 41 R, 98/41 AV, 42 R, 102, 106; 236/49, 93 R, 101 D; 403/359; 220/3.8

[56] References Cited

U.S. PATENT DOCUMENTS

| | | | |
|---|---|---|---|
| 2,271,733 | 2/1942 | Clark | 98/37 |
| 2,292,082 | 8/1942 | Miller | 236/93 R X |
| 3,366,333 | 1/1968 | Diehl | 236/101 D X |
| 3,436,016 | 4/1969 | Edwards | 236/49 |
| 3,528,606 | 9/1970 | Witten | 236/49 X |
| 3,852,514 | 12/1974 | Lauben | 220/3.8 X |
| 4,124,318 | 11/1978 | Sagady | 403/359 X |
| 4,151,952 | 5/1979 | Edwards | 98/40 VT |
| 4,175,480 | 11/1979 | Beam, Jr. et al. | 236/49 X |

*Primary Examiner*—Albert J. Makay

*Assistant Examiner*—Harold Joyce

*Attorney, Agent, or Firm*—Luke J. Wilburn, Jr.; Wellington M. Manning, Jr.

[57] ABSTRACT

An improved temperature regulated wall ventilator comprising a housing defining an air flow passageway therethrough, a plurality of louvers mounted in side by side relation in the housing passageway for pivotal movement about their longitudinal axes to open and close the air flow passageway, and temperature responsive helical spring control means located in the air flow passageway on an inner end portion of a stub shaft mounted on the housing. One end of the helical spring is attached to one of the louvers, and the other end of the spring is operatively attached to the stub shaft to prevent its relative rotation with respect thereto. The stub shaft is mounted in an opening of the housing wall, and, prior to installation of the ventilator in a wall opening, the stub shaft may be partially retracted from the housing wall and rotated to cause compression or contraction of the spring about its longitudinal axis, thereby varying the pressure of the spring on the louvers to establish a desired temperature at which the louvers are opened or closed.

8 Claims, 5 Drawing Figures

TEMPERATURE REGULATED WALL VENTILATOR CONSTRUCTION

This invention relates to an improved wall ventilator construction and, more particularly, to a temperature responsive, automatically regulated wall ventilator having adjustably positionable louvers therein for opening and closing the air flow passageway through the ventilator.

BACKGROUND OF THE INVENTION

It is well known to provide ventilation to enclosed spaces of buildings, such as crawl spaces and basements, by the use of ventilators located in openings of the foundation walls. Such ventilators are generally provided with adjustable closure means, such as shutters or louvers, to control the flow of air to and from the enclosed space, depending on temperature, weather conditions or seasonal changes. Generally such foundation wall ventilators are secured in the wall opening during construction of the foundation wall by cement, mortar, or other fastening materials.

It is also known to provide temperature responsive control of the closure shutters or louvers of such ventilators by the use of bimetallic temperature responsive springs which may be operatively connected between the fixed housing of the ventilator and the movable shutters in such a way that expansion or contraction of the springs due to temperature changes causes pivotal movement of the shutters from open to closed positions in the air flow passageway through the ventilator housing. Typical of such devices are disclosed in the following patents:

| | |
|---|---|
| French 1,377,998 | U.S. 3,068,776 |
| U.S. 2,187,767 | U.S. 3,195,441 |
| U.S. 2,241,108 | U.S. 3,368,756 |
| U.S. 2,551,965 | U.S. 3,436,016 |
| U.S. 3,027,090 | U.S. 3,528,606 |

Above-mentioned U.S. Pat. No. 3,436,016 particularly discloses a temperature responsive foundation ventilator construction having bimetallic spring operatively connected between a fixed shaft and movable shutters to provide for controlled movement thereof in response to predetermined temperature changes in the air passing through the shutter.

Although many such temperature responsive spring controlled louvered ventilators are known in the field of the art, there is an ever present need to provide a temperature-responsive, automatically controlled wall ventilator which can be more easily or economically manufactured to provide improved reliability of performance in use.

OBJECTS OF THE INVENTION

It is therefore an object of the present invention to provide an improved temperature-responsive, automatically regulated wall ventilator of the moving shutter or louver type wherein the temperature responsive control means and its means for operative connection to the shutter mechanism of the ventilator is of simplified construction.

It is another object to provide an improved temperature responsive automatically regulated ventilator wherein the temperature responsive element of the ventilator may be easily adjusted at the time of manufacture and/or installation of the ventilator to open and close the shutter mechanism of the ventilator at a preselected temperature.

It is a further object to provide an improved automatically regulated wall ventilator of lightweight construction having screening means overlying opposite ends of the ventilating passageway therethrough to protect the control elements of the shutter mechanism of the ventilator from contamination by foreign objects and materials.

It is a further object to provide a lightweight, economical foundation wall ventilator having support frame and screening member which may be snap fit onto the main housing of the ventilator to provide a compact, lightweight integral unit for use in new and pre-existing foundation wall constructions.

BRIEF DESCRIPTION OF THE DRAWINGS

The foregoing as well as other objects of the present invention will become more apparent from the following detailed description of a preferred embodiment of the invention, when taken together with the accompanying drawings, in which.

BRIEF DESCRIPTION OF THE INVENTION

In its broader aspects, the present invention comprises an improved temperature-responsive automatically regulated ventilator comprising a housing having peripheral walls defining an air flow passageway, a plurality of louvers pivotally mounted in side by side relation in the housing passageway for pivotal movement about their respective longitudinal axes to open and close the air flow passageway, and a temperature responsive bimetallic helical spring located in the air flow passageway having one end thereof operatively supported by and connected in sliding relation in a slot of a stub shaft on the housing wall to prevent its relative rotation with respect thereto. The other end of the helical spring is attached directly to one of the louvers and the shaft and spring lie generally along the pivotal axis of the louver. Prior to installation of the ventilator in a foundation wall, the contraction or expansion of the spring about its longitudinal axis may be adjusted by manual rotational movement of the stub shaft prior to its full insertion into the housing wall through which it extends, thereby adjusting the control spring to open or close the ventilator louvers at a desired temperature.

DETAILED DESCRIPTION OF PREFERRED EMBODIMENTS

Figure 1:
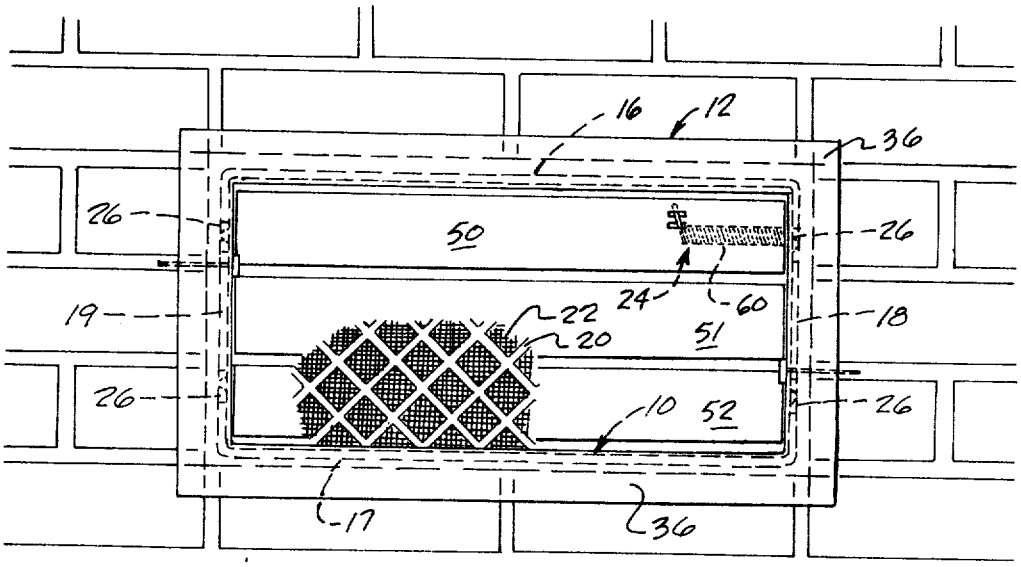
FIG. 1 is a front elevation view of the preferred form of temperature-responsive wall ventilator of the present invention as seen installed in the opening of a brick foundation wall of a building.
Figure 2:
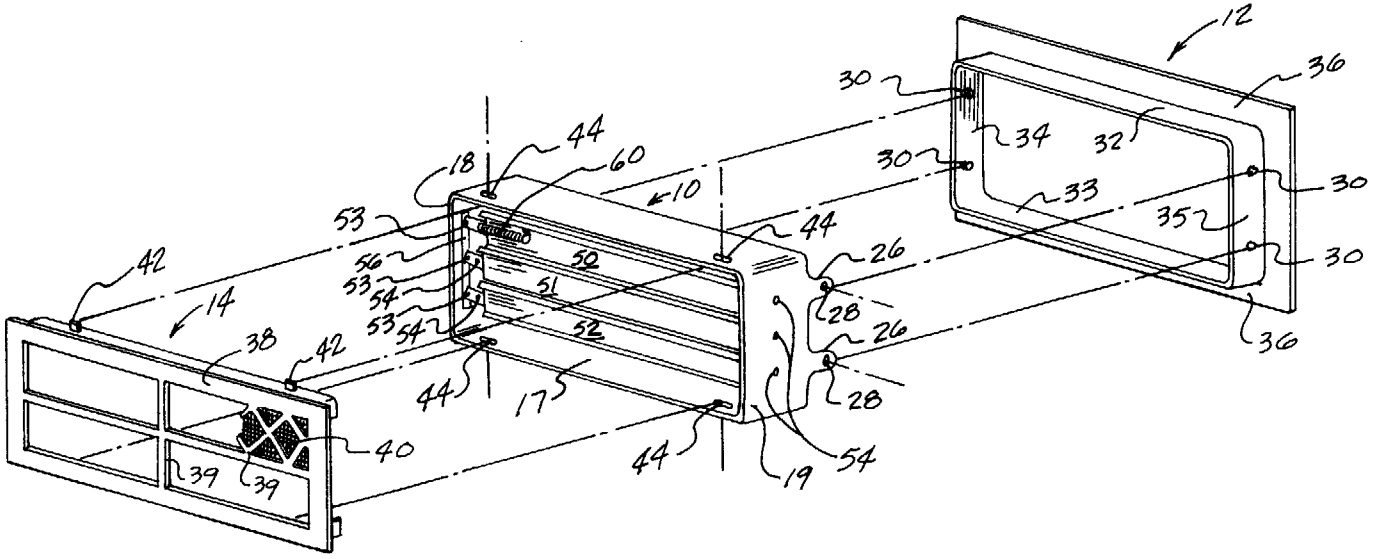
FIG. 2 is a rear perspective view of the ventilator of FIG. 1, with main housing, support frame and rear protective screening member of the ventilator exploded apart to better illustrate their manner of connection and the interior louver section of the main housing.

Referring more particularly to the drawings, and as seen in FIGS. 1 and 2, the ventilator construction of the present invention comprises a main housing 10 containing a louver mechanism, a removable front flanged support frame 12, and a removable rear protective screening member 14 for the housing.

Main housing 10 comprises opposed top, bottom and side walls 16–19 unitarily connected to form a generally rectangular air flow passageway through the housing. Unitarily formed with the housing 10 and forming a front face therefor is a protective reinforcing lattice or grid, a portion of which 20 is shown in FIG. 1, having diagonally disposed cross members. Located immediately behind lattice 20 and spanning the air flow passageway of the housing is a wire screen 22 which precludes certain foreign objects, such as bugs, leaves, animals and the like, from passing through the air flow passageway and further protects a temperature responsive control element 24 of the louver mechanism from contamination thereby. Preferably the main housing and lattice are of molded unitary plastic construction, and screen 22 may be attached to the lattice and housing by heat melting and rehardening of localized portions of the housing and lattice about adjacent portions of the screen.

Extending forwardly from the front face of housing 10 from each side wall 18, 19 are a pair of unitarily formed spaced protrusions 26 having openings 28 (FIG. 2) therethrough. Openings 28 in housing protrusions 26 receive correspondingly spaced lug elements or protrusions 30 on side wall sections of the frame 12 in snap fit relation therein, thereby removably securing the support frame 12 and housing to each other when the ventilator is placed in a foundation wall opening, as seen in FIG. 1.

As best seen in FIG. 2, frame 12 comprises opposed top, bottom and side wall portions 32–35 which extend generally parallel to respective wall portions 16–19 of main housing 10 and define an opening through the frame generally corresponding in dimension to the air flow passageway through the main housing. Frame member 12 further is provided with a peripheral flange 36 extending perpendicularly to the axis of the air flow passageway and serving to overlie peripheral portions of the front face of the foundation wall opening (FIG. 1).

As seen in FIG. 2, removably attached to the rear of the main housing and spanning the air flow passageway therethrough is removable screening member 14. Screen member 14 includes a generally rectangular frame 38, reinforcing lattice 39, and screen wire 40 secured therebehind. Rear screen member 14 is removably secured to housing 10 by means of spaced pairs of lugs 42 (only upper lugs shown in FIG. 2) located along top and bottom edge portions of the screen frame which are frictionally received in correspondingly spaced slots 44 in the top and bottom walls of the main housing in snap fit relation. The removable rear screen member thus serves to preclude passage of foreign objects into the air flow passageway of the main housing and protect the louver mechanism and temperature responsive control from contamination by bugs, small animals and other foreign matter. By providing front and removable rear screens on the main housing of the ventilator, the interior mechanisms thereof are protected from foreign objects, while ready access may be had thereto for adjustment, repair, and/or cleaning by quick removal of the rear screen member from the main housing.

Preferably, both support frame member 12 and rear screen member 14 are each unitarily formed of lightweight, resilient plastic material, and thus may be quickly assembled in snap fit relation to housing 10 during installation of the ventilator in a wall opening at a building site location.

Figure 3:
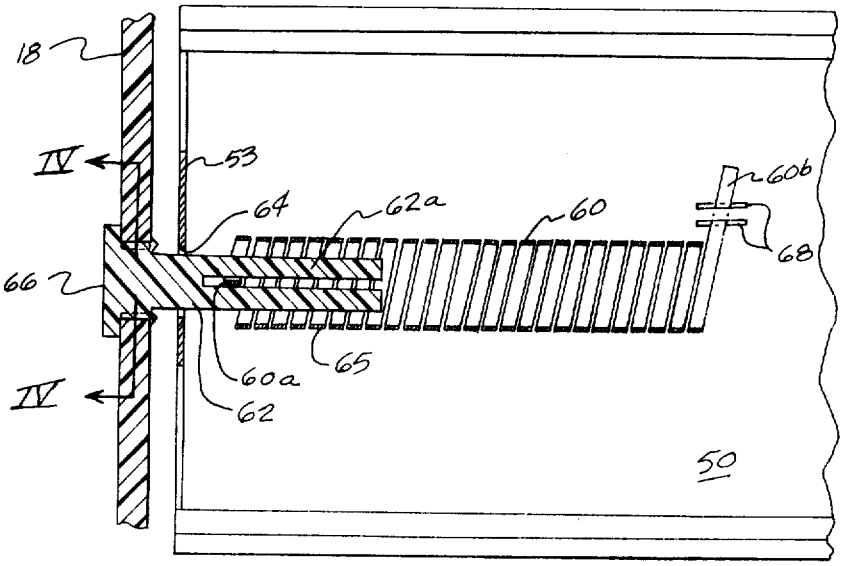
FIG. 3 is an enlarged elevation view, with portions in section, of the left hand end portion of the upper louver of the ventilator, as seen in FIG. 2, and better illustrating the temperature responsive control spring mechanism of the ventilator and its operative interconnection to the louver section of the ventilator.
Figure 4:
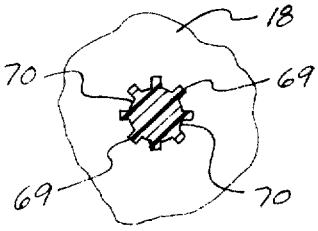
FIG. 4 is a fragmentary view taken generally along line IV—IV of FIG. 3 and looking in the direction of the arrows, with portions shown in section therein.

Details of the operation and automatic regulation of the louver mechanism of the ventilator may be best described and understood by reference to FIGS. 2–4. As seen, the louver mechanism of main housing 10 comprises three elongate generally rectangular louvers 50–52 mounted in side by side relation for pivotal movement about their respective longitudinal axes to open and close the air flow passageway through the main housing. Each end of each of the louvers is provided with a bent, ear portion 53 (only three of which are shown in FIG. 2) which extends perpendicular to the plane of the louver and the ear portions are attached to the adjacent side wall of the housing by pivot means, such as rivets 54.

Ear portions 53 on one end of the louvers (left side of housing as seen in FIG. 2) are operatively interconnected by means of a vertical connecting arm 56 which is pivotally connected by pivot pins to each ear portion such that pivotal movement of any one of the louvers about its points of attachment to the housing causes corresponding pivotal movement of the other louvers.

As seen in FIG. 1, located behind the right hand end of upper louver 50 of the louver mechanism in the air flow passageway of the housing is temperature-responsive control means 24 which includes an elongate bimetallic helical spring 60. As best seen in FIG. 3, spring 60 is supported on the pivotal axis of louver 50 by means of a short stub shaft 62 which extends through an opening of the side wall 18 of housing 10, through an opening 64 in the ear portion 53 of louver 50, and for only a short distance into the air flow passageway of the housing. The inner end portion 62a of stub shaft 62 is provided with a transversely disposed, elongate slot 65, and the outer end of the stub shaft has an enlarged head portion 66 (FIGS. 3 and 5) which engages the inner edges of side wall 18 opening to prevent rotation of the stub shaft when it is fully extended into the air flow passageway. A straightened end portion 60A of the helical spring is slidably received in stub shaft slot 65 and is slidable therealong, with the end portion of the spring disposed in surrounding relation to the end portion of the stub shaft. By extending through the opening 64 of the ear portion 53 of louver 50, stub shaft 62 not only serves to operatively secure the spring 60 to the housing 10, but also serves to support the end of louver 50 on housing wall 18 for pivotal movement without the necessity of additional pivot means or fastening rivet at that end of the louver.

The other straightened end 60b of the elongate helical spring is directly attached to the face of louver 50 by means of a pair of spaced slots 68 cut in the louver through which the straightened end extends.

Figure 5:
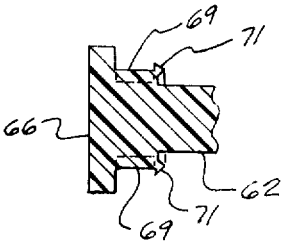
FIG. 5 is an enlarged, vertical cross-sectional view of the head portion of the stub shaft supporting the temperature-responsive spring, as seen in FIG. 3.

As seen in FIG. 4, the peripheral surface of head portion 66 of stub shaft 62 is provided with a plurality of serrations or tips 69 which are matingly received with corresponding serrations 70 on the inner edge of the opening in side wall 18 when the stub shaft is moved to fully extended position in the air flow passageway of the housing. The mating serrations of the stub shaft and side wall opening ensures non-rotational movement of the stub shaft when it is fully engaged with the opening. As seen in FIG. 5, located inwardly of the serrations 69 along the stub shaft 62 toward its inner end is a resiliently deformable peripheral rib portion 71 of the stub shaft which overlies and frictionally engages the inner surface of side wall 18 in snap fit relation to secure the stub shaft in the wall opening against accidental displacement, while permitting the stub shaft to be manually retracted from the opening, when desired.

As can be appreciated from the foregoing description, the compression and expansion of the temperature-responsive bimetallic control spring 60 may be adjusted by manual rotation of stub shaft 62 prior to initial installation of the ventilator to set a desired temperature at which a change in pressure of contraction and expansion of the spring on the louvers due to temperature change will cause the louver mechanism of the housing to open or close. Presuming that it is desired that the louvers 50–52 be fully opened at a temperature of 70° F., the assembled main housing 10 containing louver mechanism and temperature responsive control spring are placed in a controlled temperature environment of 70° and allowed to reach equilibrium. Stub shaft 62 is then manually partially withdrawn from side wall 18 opening to disengage the enlarged head portion from the opening while still retaining the end **60*a* of spring 60 in the elongate slot 65** of the stub shaft. The stub shaft is then manually rotated in a desired direction until the louvers just reach fully open position in the housing passageway. The stub shaft is then pushed back into the side wall opening until the head portion is again engaged in snap fit relation with the opening to prevent further rotational movement of the stub shaft. In this manner, the temperature control spring has been set so that the louvers will fully open at a temperature of 70° F.

To install the ventilator system in a foundation wall opening, the frame member, main housing and removable screen are assembled, as described, and the unit placed in the opening. The unit then may be secured against displacement from the opening by mortar or cement, or holes may be drilled in the side walls of the frame or housing in alignment with mortar joints of the brick wall, and masonry nails driven through the holes into the wall.

That which is claimed is:

1. An improved temperature regulated wall ventilator comprising a housing having peripheral wall means defining an air flow passageway therethrough, a plurality of louvers, means mounting said louvers in side by side relation in said housing passageway for pivotal movement about their respective individual longitudinal axes to open and close said air flow passageway in response to a predetermined temperature change;

said mounting means including an opening through a peripheral wall portion of said housing, a stub shaft extending through and having a head portion engageable with the inside edge of said housing peripheral wall opening to prevent rotational movement of the stub shaft, said stub shaft extending only partially across said air flow passageway along the pivotal axis of one of said louvers, an elongate bimetallic helical spring located in said air flow passageway in surrounding relation to an inner end portion of said stub shaft; means operatively attaching one end of said helical spring to said stub shaft comprising a transversely disposed, elongate slot extending along an inner end portion of said stub shaft and receiving said one end of said spring for sliding movement therealong while preventing its relative rotational movement about said stub shaft; means attaching the other end of said helical spring directly to said one of said louvers whereby contraction and expansion of said spring about its longitudinal axis in response to temperature changes causes corresponding pivotal movement of said louver about its pivotal axis, means interconnecting said louvers to impart pivotal movement to all of said louvers in response to pivotal movement of said one of said louvers by said spring to open and close said air flow passageway of said ventilating housing; and wherein said spring may be contracted or expanded about its longitudinal axis relative to its point of attachment to said one louver by manual rotation of said stub shaft when partially withdrawn from said air flow passageway with its head portion out of engagement with the inside edge of said wall opening.

2. A ventilator as defined in claim 1 wherein said means attaching said other end of said spring directly to said one of said louvers comprises and extension of said other end extending theough a slotted portion of the face of said louver.

3. A ventilator as defined in claim 1 wherein said head portion of said stub shaft is serrated about its periphery, and said inside edge of said housing peripheral wall opening is correspondingly serrated to receive said serrated portion of said head portion of the stub shaft therein and prevent rotational movement of the stub shaft.

4. A ventilator as defined in claim 1 wherein said stub shaft also is a part of said means for mounting said one of said louvers in said housing for pivotal movement about its longitudinal axis.

5. A ventilator as defined in claim 1 including screening means extending across said air flow passageway on opposite sides of said helical spring located therein to protect said spring against contamination by foreign materials.

6. A ventilator as defined in claim 5 wherein said screening means comprises support lattice means formed unitary with said housing and extending across said air flow passageway at one end thereof, a screen wire disposed behind said lattice means and being secured thereto, and a removable screening member at the other end of said passageway and extending across said passageway, said removable screening member including a peripheral frame frictionally engageable with peripheral wall portions of said housing forming said air flow passageway to retain said screen member on said housing while permitting its ready removal to gain access to the interior of said housing.

7. A ventilator as defined in claim 6 wherein said housing includes one or more spaced protrusions extending outwardly from the front of the peripheral wall means of said housing, each of said protrusions having an opening therein, a support frame having peripheral wall members defining an air flow passageway through said frame corresponding in size to said housing air flow passageway, peripheral flange means on said peripheral wall members of said frame and extending perpendicularly outwardly of said frame air flow passageway, and correspondingly spaced protrusion means on said peripheral wall members of said frame frictionally engageable with said openings in said spaced protrusions of said housing to retain said frame thereon with the air flow passageways of the frame and housing aligned.

8. A ventilator as defined in claim 1 wherein said housing and said support frame are each unitarily formed of plastic material.

* * * * *